US005230226A

United States Patent [19]

Saarikettu

[11] Patent Number: 5,230,226

[45] Date of Patent: Jul. 27, 1993

[54] METHOD FOR MANUFACTURING A FILTER RESISTANT TO HIGH TEMPERATURE

[76] Inventor: Jukka E. Saarikettu, Kustaa Adolfinkatu 78, SF-67200 Kokkola, Finland

[21] Appl. No.: 815,498

[22] Filed: Dec. 30, 1991

[51] Int. Cl.[5] ..... D04B 1/14

[52] U.S. Cl. ..... 66/202; 210/499; 55/527; 55/528; 55/DIG. 45

[58] Field of Search ..... 55/527, 528, 131; 66/DIG. 45, 202, 198, 190; 210/499

[56] References Cited

U.S. PATENT DOCUMENTS 3,424,220 1/1969 Schuerch ..... 66/202
3,920,428 11/1975 Kinsley ..... 55/528
3,930,815 1/1976 Masuda ..... 55/123

FOREIGN PATENT DOCUMENTS 1122832 9/1956 France ..... 66/202
1437076 11/1988 U.S.S.R. ..... 15/DIG. 43

*Primary Examiner*—Bernard Nozick
*Attorney, Agent, or Firm*—Brooks & Kushman

[57] ABSTRACT

A method of manufacturing a filter resistant to high temperatures and mechanical stress, includes forming a fiber secured to a suitable framework wherein a double-sided knitted fabric is knitted from a fiber resistant to high temperatures, e.g. poly(m-phenyleneisopthalamide) fiber, on a knitting machine with two rows of needles, and a reinforcing fiber resistant to high temperatures, e.g. aromatic polyamide fiber is fed on top of the fabric, and on top of this a new double-sided fabric, wherein the reinforcing fiber remains in the channels formed by the transverse loops of the knitted structure, after which a piece of this fiber structure is secured to a suitable frame.

2 Claims, 2 Drawing Sheets

METHOD FOR MANUFACTURING A FILTER RESISTANT TO HIGH TEMPERATURE

TECHNICAL FIELD

This invention relates to a filter resistant to high temperatures, and a method for manufacturing it, and more particularly to a method in which the filter is formed from a fiber net, by securing it to a suitable framework.

BACKGROUND ART

Often the temperature resistance of a conventional dust filter limits its application as the temperature of a process utilizing the filter exceeds the temperature range of the filter. It is possible to achieve a high temperature application by using steel net, but often these filters do not withstand corrosive substances. Nets of other metals can also be used, but these are quite expensive. Typically the filter must also withstand abrasion and pressure impacts, which are used at regular intervals to clean it.

International Patent Application PCT/FI89/20 discloses a method of manufacturing an oriented fiber structure, in which it is most advantageous to use a double disc knitting machine, on account of its great manufacturing output. In accordance with this disclosure, two rows of needles knit loops in different directions, which form lateral channels, into which it is possible to feed reinforcing fibers. A corresponding textile product, the structure of which is similar to that shown in this international application, is known from British application publication 2 121 837.

DISCLOSURE OF INVENTION

An object of the present invention is to create a new type of filter, which withstands pressure impacts and high temperatures, as well as being highly resistant to abrasion.

Another object of the present invention is to provide an improved method of manufacturing a filter resistant to high temperatures.

In carrying out the above objects and other objects of the invention a filter resistant to high temperatures is formed of a net-like fiber structure set in a frame. The fiber section is formed from double-side knitted poly (m-phenyleneisopthalamide) fabric, the preferred material of which is Nomex® or other fiber resistant to high temperatures. Aromatic polyamides referred to as aramids or other corresponding reinforcing fiber is set in the channels formed by the transverse loops of the double-side knitted fabric.

Preferably, the filter can be made to conduct electricity by adding carbon fibers, which conduct electricity, to the oriented fibers. The carbon fibers are therein connected to a suitable electrode at the edges of the filter. The oriented fibers can be both filament and spun fibers.

The method of manufacturing the filter includes forming a fiber net secured to a suitable framework. A double-sided fabric poly(m-phenyleneisopthalamide) is knitted on a knitting machine equipped with double rows of needles from a fabric that withstands high temperatures, e.g. Nomex® fiber, and a high temperature resistant reinforcing fiber e.g. aramid fiber is fed on top of this fabric. On top of this is knitted a new double-sided fabric, wherein the reinforcing fiber remains in the channels formed by the transverse loops of the knitted structure. The double-sided fabric is then secured to the framework.

In what follows, the invention is illustrated by means of the accompanying examples, which depict the knitted structure applied to a filter.

BEST MODE FOR CARRYING OUT THE INVENTION

Figure 1:
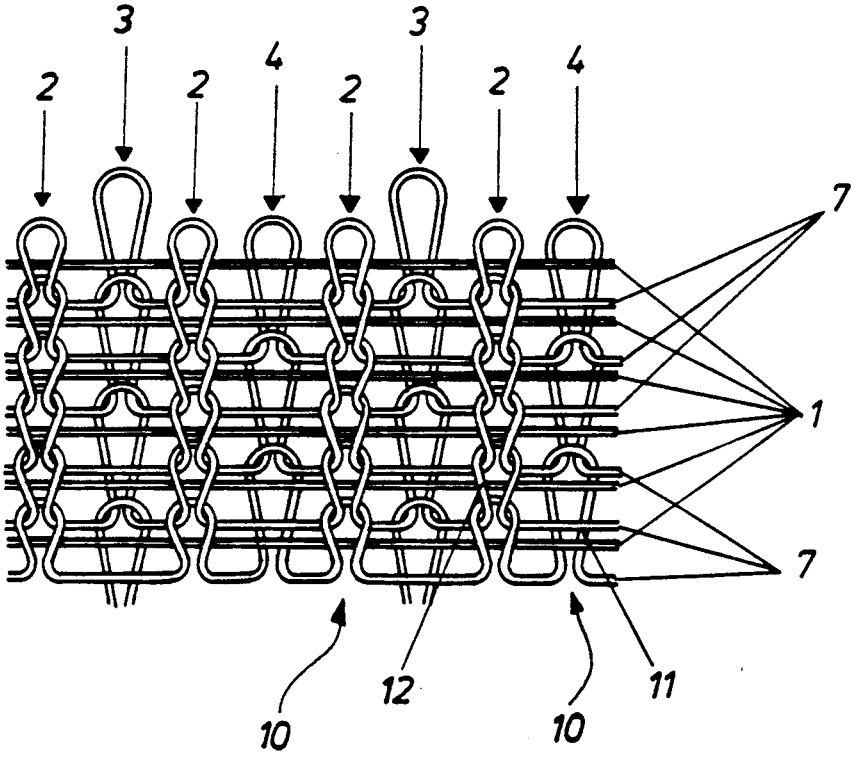
FIG. 1 is an enlarged sectional plan view of a filter constructed in accordance with the present invention illustrating the structure of knitted fabric.
Figure 2:
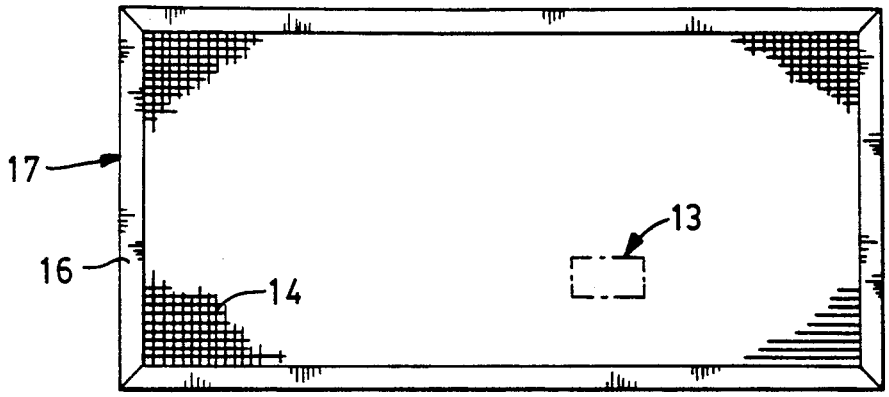
FIG. 2 is a plan view of the filter of FIG. 1 illustrating a framework securing the knitted fabric.
Figure 3:
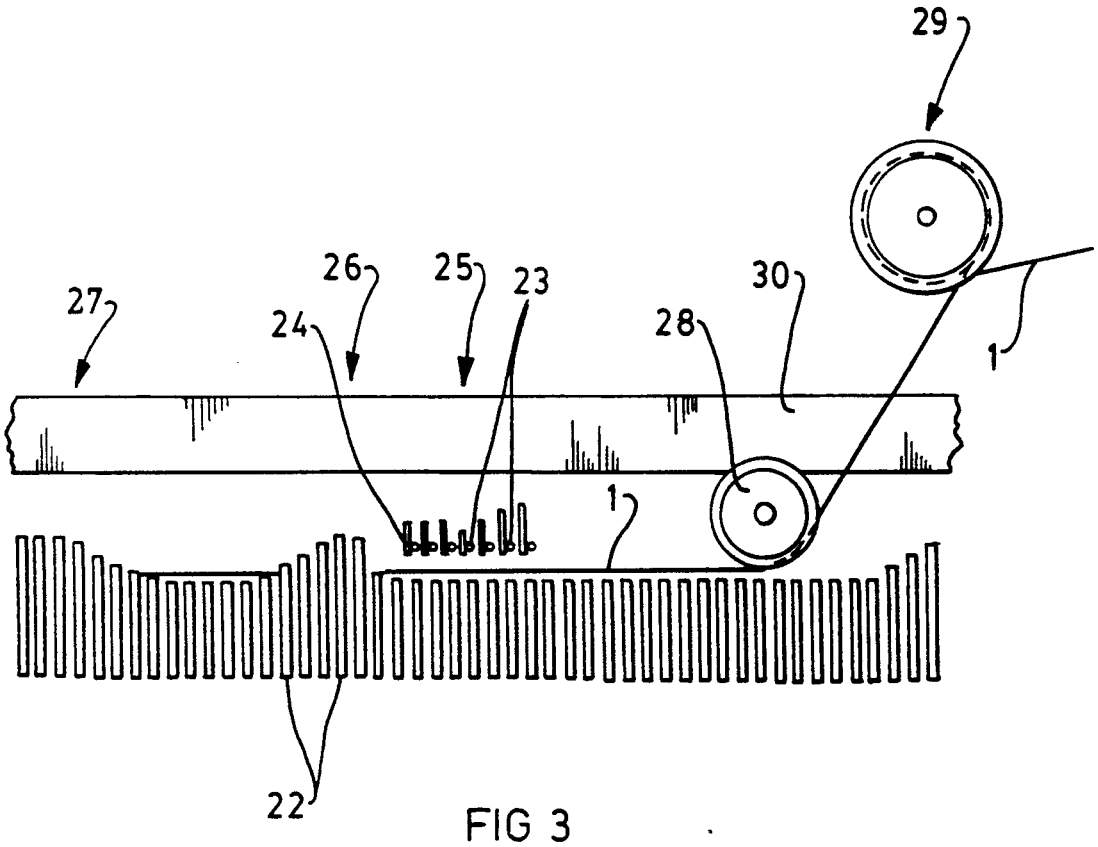
FIG. 3 is a schematic view of a circular knitting machine illustrating a dial plate.

With reference to FIGS. 1 and 2, a knitted fabric is created on a double disc or circular knitting machine shown in FIG. 3, in which there are cylinder needles in the vertical direction and disc needles in the horizontal. Preferably, poly(m-phenyleneisopthalamide) or aromatic polyamide fibers which withstand high temperatures, are used as the support fibers 7, i.e. as a loop filament in the fabric. The needles on the cylinder side are set to knit loops 2 in each feed in different systems. The disc needles are set to the so-called interlock setting and the knitting takes place alternately in each sequential feed. The loops knitted by the disc needles are marked with the reference numbers 3 and 4.

The aromatic polyamide fibers, generally referred to as aramid fibers 1 are fed on every second system, and they remain in the channels formed by the loops 2, 3 and 4 running in different directions. The aramid fibers 1 remain transverse in relation to the wales 10 of the fabric. Due to the interlock setting, the fabric tends to shrink longitudinally, when the reinforcing fibers become very dense. In this way the filter also becomes tight. Preferably poly(m-phenyleneisopthalamide) fibers referred to as Nomex® fibers, and sold by the DuPont company, can also be used in place of aramid fibers as the oriented fibers.

As an example, reference can be made to two trial runs, in which the following materials and machine settings were used.

EXAMPLE 1

Surface 25 Tex Nomex®. Infill 2×25 Tex Nomex®, every sixth infill thread Aramid 142 Tex.

| System 1 | | |
|---|---|---|
| 10 | 17 | 10 |
| B | 2. B | 3. A |
| — | — | — |
| k.c. | pass | k.c. |
| 15 | | 15 |

k.c. = knit close

EXAMPLE 2

Surface 25 Tex Nomex®. Infill 2×25 Nomex®, every sixth infill thread 200 Tex Carbon.

| System 1 | | | | | |
|---|---|---|---|---|---|
| | 17 | 10 | | | |
| 1. pass | 2. A | 3. B | 4. pass | 5. B | 6. A |
| — | — | — | — | — | — |

-continued

| System 1 | | | | | |
|---|---|---|---|---|---|
| B | pass | all | A | pass | all |
| 15 | | 15 | | | |

In the latter example, carbon fiber, which conducts electricity, is used as a component. The carbon fibers are connected to a common electrode, in which case the filter can either be effectively earthed, or else it may be used as part of an electric filter. It is also possible to use two electrodes in such a way that some of the fibers are connected to the first electrode, and the remainder to a second electrode.

It is advantageous to use partly aramid filament fibers and partly spun fibers as the oriented fibers. The filament fibers provide the fabric with stiffness, and the spun fibers make the filter as dense as desired, i.e. determine the size of penetrating particles. The aramid fibers also exhibit high sulphur resistivity which is desirable in many industrial filter applications.

FIG. 2 shows a filter 17, which consists of a framework 16 securing a fiber net 14. The area indicated by 13 is illustrated in FIG. 1 showing the structure of a knitted fabric.

FIG. 3 is a schematic developed view of part of circular knitting machine in the region of the dial plate 30. Needles 22 are mounted in the cylinder (not shown) of the machine beneath the dial plate 30. Associated with the cam system is a fiber guide, a roller 28 and brake device 29 keeping fiber always in even trust. Other features and the method is disclosed in the GB publication 2 121 837 which is hereby incorporated by reference.

While the best mode for carrying out the invention has been described in detail, those familiar with the art to which this invention relates will recognize various alternative designs and embodiments as defined by the following claims.

What is claimed is:

1. A method for manufacturing a filter resistant to high temperatures, in which the filter is formed of a fiber net by securing it to a suitable framework, characterized in that a double-sided fabric is knitted on a knitting machine equipped with double rows of needles from a poly(m-phenyleneisopthalamide) fabric that withstands high temperatures, and a high temperature resistant reinforcing aromatic polyamide fiber is fed on top of this fabric, and on top of this a new double-sided fabric, in which case the reinforcing fiber remains in the channels formed by the transverse loops of the knitted structure, after which a piece of this kind of fiber structure is secured to a suitable frame.

2. The method of claim 1 characterized in that carbon fiber is knitted into the fiber net to make it electrically conductive.

* * * * *